United States Patent [19]

Keisers et al.

[11] Patent Number: 4,627,481

[45] Date of Patent: Dec. 9, 1986

[54] REFRACTORY CONDUIT ASSEMBLY FOR SUPPLYING MOLTEN STEEL FROM A DISCHARGE VESSEL TO AN INGOT MOLD

[75] Inventors: Laurenz Keisers, Krefeld; Gerd Artz, Ratingen; Dieter Figge, Essen; Clemens Philipp, Meerbusch; Hans Siemer, Essen, all of Fed. Rep. of Germany

[73] Assignee: Didier-Werke AG, Wiesbaden, Fed. Rep. of Germany

[21] Appl. No.: 636,241

[22] Filed: Jul. 31, 1984

[30] Foreign Application Priority Data

Aug. 8, 1983 [DE] Fed. Rep. of Germany ..... 3328586

[51] Int. Cl.[4] ..... B22D 11/10

[52] U.S. Cl. ..... 164/440; 164/337; 164/437; 222/591; 222/597; 222/606

[58] Field of Search ..... 164/415, 437, 439, 440, 164/475, 488, 489, 490, 133, 337, 137, 339; 222/591, 594, 597, 601, 602, 606, 607

[56] References Cited

U.S. PATENT DOCUMENTS

| | | | |
|---|---|---|---|
| 4,217,947 | 8/1980 | Gyongos et al. | 164/488 |
| 4,300,621 | 11/1981 | Wilson | 164/440 |
| 4,340,110 | 7/1982 | Honda et al. | 164/440 |
| 4,429,816 | 2/1984 | Thrower | 222/606 |
| 4,436,143 | 3/1984 | Sevastakis | 164/440 |

FOREIGN PATENT DOCUMENTS

| | | | |
|---|---|---|---|
| 247657 | 2/1963 | Australia | 222/597 |
| 1083262 | 9/1967 | United Kingdom | 164/337 |
| 1198777 | 7/1970 | United Kingdom | 164/337 |

*Primary Examiner*—Nicholas P. Godici
*Assistant Examiner*—Richard K. Seidel
*Attorney, Agent, or Firm*—Wenderoth, Lind & Ponack

[57] ABSTRACT

A refractory conduit assembly for the transfer of molten steel from a discharge vessel to an ingot mold of a horizontal continuous casting plant includes a replaceable spout member adapted to be removably connected at a predetermined location to the refractory lining of a vessel. The spout member has therethrough a discharge channel to receive from the interior of the vessel a flow of molten steel. A shut off device is provided to interrupt the flow to the discharge channel. A casting tube has therethrough a flow passage with inlet and outlet ends. A coupling device connects the inlet end of the flow passage to the discharge channel, such that the flow of molten metal passes through the casting tube. The outlet end of the flow passage has an altered cross-sectional configuration adapted to that of the ingot mold. A nozzle has an inlet end connected to the casting tube and an outlet end having thereat a portion to sealingly contact walls of the ingot mold. The nozzle has therethrough a flow channel to pass the flow of molten steel from the casting tube to the ingot mold.

46 Claims, 12 Drawing Figures

REFRACTORY CONDUIT ASSEMBLY FOR SUPPLYING MOLTEN STEEL FROM A DISCHARGE VESSEL TO AN INGOT MOLD

BACKGROUND OF THE INVENTION

The present invention relates to a refractory conduit or duct assembly or connection, particularly for the transfer of molten steel from a discharge vessel such as a tundish to an ingot mold of a horizontal continuous casting plant having revolving ingot mold walls in the form of endless belts.

In the past it has been customary to use continuous casting plants for the casting of non-ferrous metal such as lead, zinc, copper and the like. Such casting plants have employed ingot molds having walls formed by cooled endless belts, whereby it was possible to obtain relatively high teeming rates of approximately 10 meters per minute. Accordingly, it was possible to obtain relatively high rates of casting, with relatively few pieces of stationary equipment. The molten metal is tranferred to the ingot mold from the tundish through an open refractory trough.

By contrast, the continuous casting of molten steel preferably occurs in vertically oscillating ingot molds into which dips, with the feeding orifice below the steel bath surface, an immersion nozzle connected vertically to the tundish and so constructed that it is airtight, thereby to prevent atmospheric air from reaching the molten steel. The maximum teeming rates are 3 to 4 meters per minute, whereby the rates of casting remain relatively low, despite the considerable amount of stationary equipment necessitated by the tundish lid.

It is however desirable to be able to employ horizontal continuous casting plants for the casting of steel bars.

SUMMARY OF THE INVENTION

Accordingly, it is the primary object of the present invention to provide a refractory conduit or duct assembly or connection formed of bodies that are joined together for teeming molten steel from a discharge or distributing vessel such as a tundish to an ingot mold or casting machine of a horizontal continuous casting plant.

It is a further object of the present invention to provide such an assembly which is reliable in operation, which is airtight to prevent the molten steel from again being oxidized, which has a design that is suited to simple and rapid assembly, and which enables individual components or parts to be replaced without difficulty.

The above and other objects are achieved in accordance with the present invention by the provision of a refractory conduit assembly including a replaceable spout member adapted to be removably connected at a predetermined and reproducible location in the refractory lining of a vessel such as a tundish. The spout member has therethrough a discharge channel to receive from the interior of the vessel a flow of molten steel and to lead such flow to the exterior of the vessel. A shutoff device is provided to interrupt the flow of molten steel to the discharge channel. A casting tube has therethrough a flow passage with inlet and outlet ends. The casting tube may be directly or indirectly connected to the spout member, such that the flow of molten steel passes from the discharge channel of the spout member to the flow passage of the casting tube. The outlet end of the flow passage of the casting tube has an altered cross-sectional configuration adapted to be similar to that of an ingot mold to which the flow of molten steel is supplied. The casting tube has connected thereto a nozzle having an outlet end with means for sealingly contacting the walls of the ingot mold. A coupling device may be employed to connect the casting tube to the spout member.

The above arrangement of the present invention results in a refractory conduit assembly composed of two basic components that can be operated and assembled or disassembled with relative ease. A first such component includes the spout member that can be built into the lining of the vessel and that can be preassembled with a shutoff device and with the coupling device. The second component includes the casting tube which, together with the nozzle, can be joined as an adjustable unit to the component including the spout member. It is possible to prepare and assemble the two components separately prior to use, and then to complete the assembly by joining the two components or units together. That is, it is possible to build the spout member unit into the vessel lining, and then to move the casting tube unit to the thus located spout member unit. Thereby, assembly and disassembly required at a job site are reduced. Moreover, the various parts of the units can be readily exchanged, or still usable parts of unusable units can be reused. In addition, the various parts can be joined together for safe and airtight operation in accordance with techniques recognized and practiced in the refractories industry.

Advantageously, the spout member comprises a prefabricated wedge-shaped element installed or built into the vessel lining, and particularly in the bottom thereof, in a manner to be accessible from the outer surface of the vessel. Further preferably, the spout member is positioned at a predetermined location in the vessel lining by means of shaped bricks arranged at predetermined positions in the lining, these bricks having surfaces abutting with mating surfaces of the spout member. This arrangement makes it possible to rapidly exchange spout members, while replacing a new spout member in a precisely reproducible position. Such bricks include a first or portal-shaped brick built into a wall of the vessel lining and having therein a vertically upwardly extending recess defining an upper surface and side surfaces abutting mating surfaces of the spout member, and a second, generally horseshoe-shaped brick built into the bottom of the vessel lining and having therein a horizontally inwardly extending recess defining an inner surface abutting an inner end of the spout member and side surfaces abutting side walls of the spout member.

The discharge channel through the spout member has a rectangular cross section, and the shutoff device includes an outlet member embedded in the spout member and having therethrough a discharge opening joining the discharge channel and cooperable with a stopper of the vessel to shutoff the flow of molten steel. This arrangement results in a relatively low overall height of the assembly.

The spout member preferably is formed of a chemically or hydraulically bound refractory concrete. A mounting plate or bar may be embedded in the refractory concrete forming the spout member, such plate or bar projecting outwardly from the vessel to facilitate handling of the spout member. The refractory concrete forming the spout member may have embedded therein, in the area defining the discharge channel, an admixture of steel fibers. This strengthens the area through which flows the molten metal.

In accordance with a further feature of the present invention, the coupling element may be interposed between the spout member and the casting tube, or alternatively the casting tube may be directly connected to the spout member. The outer end of the spout member has therein a circular groove surrounding the discharge channel and receiving a circular flange on the coupling element. Also, the spout member has planar guide surfaces abutting planar side surfaces of the coupling element. In a preferred arrangement of the present invention, the coupling element includes a generally cylindrical body connected to the spout member and a generally hemispherically shaped member connected to the cylindrical body and to the casting tube. The cylindrical body and the hemispherically shaped member have therethrough connected respective channels connecting the discharge channel of the spout member to the flow passage of the casting tube. The hemispherically shaped member is formed as a separate element for production engineering reasons. The two elements are connected together by means of an annular flange engaged in a mating annular groove. Preferably, the channel in the cylindrical body converges from the rectangular cross section of the discharge channel of the spout member to a circular cross section of the channel in the hemispherically shaped member and of the flow passage in the casting tube. Furthermore, the channel of the hemispherically shaped member is inclined to the channel of the cylindrical body, but is parallel to the flow passage of the casting tube. In other words, the flow passage of the casting tube is inclined to the discharge channel of the spout member, and this inclination is carried into the channels of the two elements of the coupling element.

In accordance with a further feature of the present invention, the casting tube includes at an inlet end thereof a flange having a concave, somewhat spherical surface seating on the hemispherically shaped member. This flange also has a planar surface, and a metal jacket is fixed about the inlet end including the flange by a mortar layer, the jacket having a planar surface abutting the planar surface of the flange. The casting tube is positioned in an adjustable metal holding frame by means of the metal jacket which abuts such holding frame. This construction makes it possible to provide mating connections to the coupling element and to the nozzle, whereby the metal jacket can be reused on new casting tubes and can be mortared in position by means of a pattern mold to obtain a snug fit. This makes it possible to achieve a precise mounting of the casting tube in the metal frame, as is necessary for transmission of contact forces, as will be apparent in the following.

In accordance with a further feature of the present invention, the casting tube includes a main tube portion having around the exterior thereof insulation in the form of half shell-shaped members. The casting tube further has an outlet portion having a flared converging shape having around the exterior thereof framed mat insulation made of ceramic fibrous material. Thereby, in addition to the desired insulating effect, during the clamping of the casting tube in the holding frame, a certain compensation is achieved with variations of dimensional tolerances with regard to the outside diameter of the casting tube. The outlet end of the casting tube has a sealing flange surrounding the free outlet end of the flow passage, which flange is sealingly received in a groove formed in an inlet end of the nozzle.

In accordance with a yet further feature of the present invention, the nozzle is formed of a molten steel-repellent material and has therearound an insulation layer over which fits in a relatively tight manner a metal housing having an outer surface which is flush with an outwardly extending peripheral rim at the outlet end of the nozzle, which rim forms the means for providing a seal with the ingot mold. By this structural arrangement, the nozzle remains substantially free of clot formation in the flow channel and can withstand in the best possible manner the strains of the internally acting molten steel and of the ingot mold walls cooled temporarily at a relatively high speed, thereby to achieve extremely satisfactory holding times. The nozzle is easily and reliably secured to the casting tube through the metal housing by means of chucking devices which, are hinged to the holding frame of the casting tube. It has been established that it is advantageous to provide the nozzle in the form of a main body having therearound the insulation layer and a separate nozzle tip including the peripheral rim. The main body and the nozzle tip are sealed against each other by abutting, centered, planar ground faces. By this arrangement, a prematurely worn nozzle tip can be readily replaced. Furthermore, a more economical material, preferably boron nitrite, can be employed as the material for the nozzle tip, thereby offering improved safety with respect to free flow of the molten steel and wearing resistance. Pins on the metal housing can extend into the nozzle tip, whereby the chuck devices, the metal housing and the pins move the nozzle tip toward the main body.

To particularly overcome the problem of preventing air from entering the area of contact between the nozzle and the ingot mold, the present invention provides an arrangement at the nozzle tip. This arrangement specifically includes a peripheral space around the main body between the abutting respective planar surfaces and the layer of insulation, for example by removing a leading portion of the insulation layer. An inert gas inlet connection may be provided within the metal housing to supply inert gas to the peripheral space. Outlet holes may be provided in the metal housing communicating with the peripheral space, thereby enabling the inert gas to escape therefrom and to provide a curtain to prevent atmospheric air from entering the ingot mold.

BRIEF DESCRIPTION OF THE DRAWINGS

Other objects, features and advantages of the present invention will be apparent from the following detailed description, taken with the accompanying drawings, wherein:

FIG. 4 is an end view of a coupling element, taken along line A—A of FIG. 2;

FIGS. 5 and 6 are end views of insulation members taken along lines B—B and C—C, respectively, of FIG. 1;

DETAILED DESCRIPTION OF THE INVENTION

Figure 1:
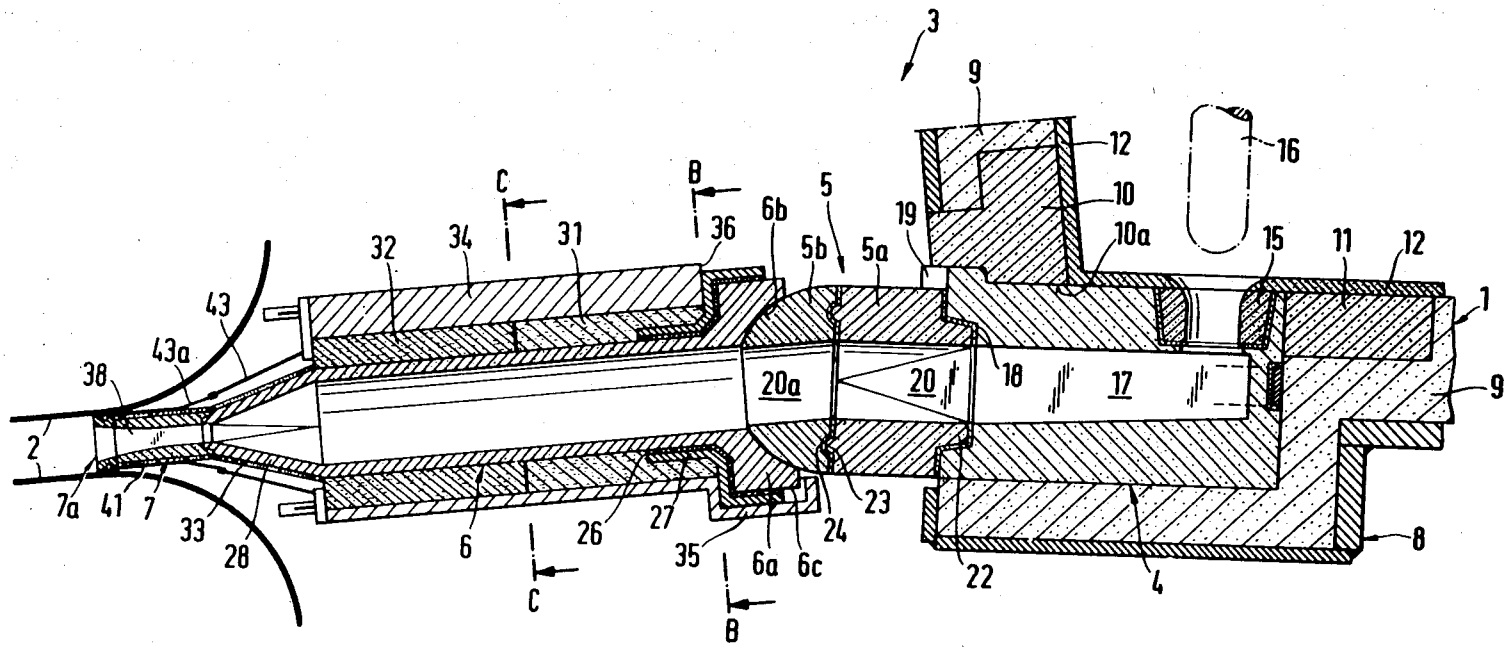
FIG. 1 is a longitudinal sectional view through a refractory conduit assembly according to the present invention, shown mounted in the bottom of a tundish, and also shown in position to supply molten steel into an ingot mold.

In FIG. 1 there is shown a metallurgical vessel 1, for example a tundish. For the sake of simplicity, only the lower spout area of the vessel 1 is shown. Molten steel is to be teemed from the vessel into an ingot mold 2, which is shown only schematically, or to a casting machine with revolving ingot mold walls. A refractory conduit or duct assembly or connection 3 in accordance with the present invention is provided to form an airtight passage. The assembly 3 of the present invention includes a replaceable spout member 4, a coupling element 5, a casting tube 6 and a nozzle 7, all of these elements being connected together in a manner to be described in more detail below to provide an airtight passage for a flow of molten steel from vessel 1 to ingot mold 2.

Figures 2, 3:
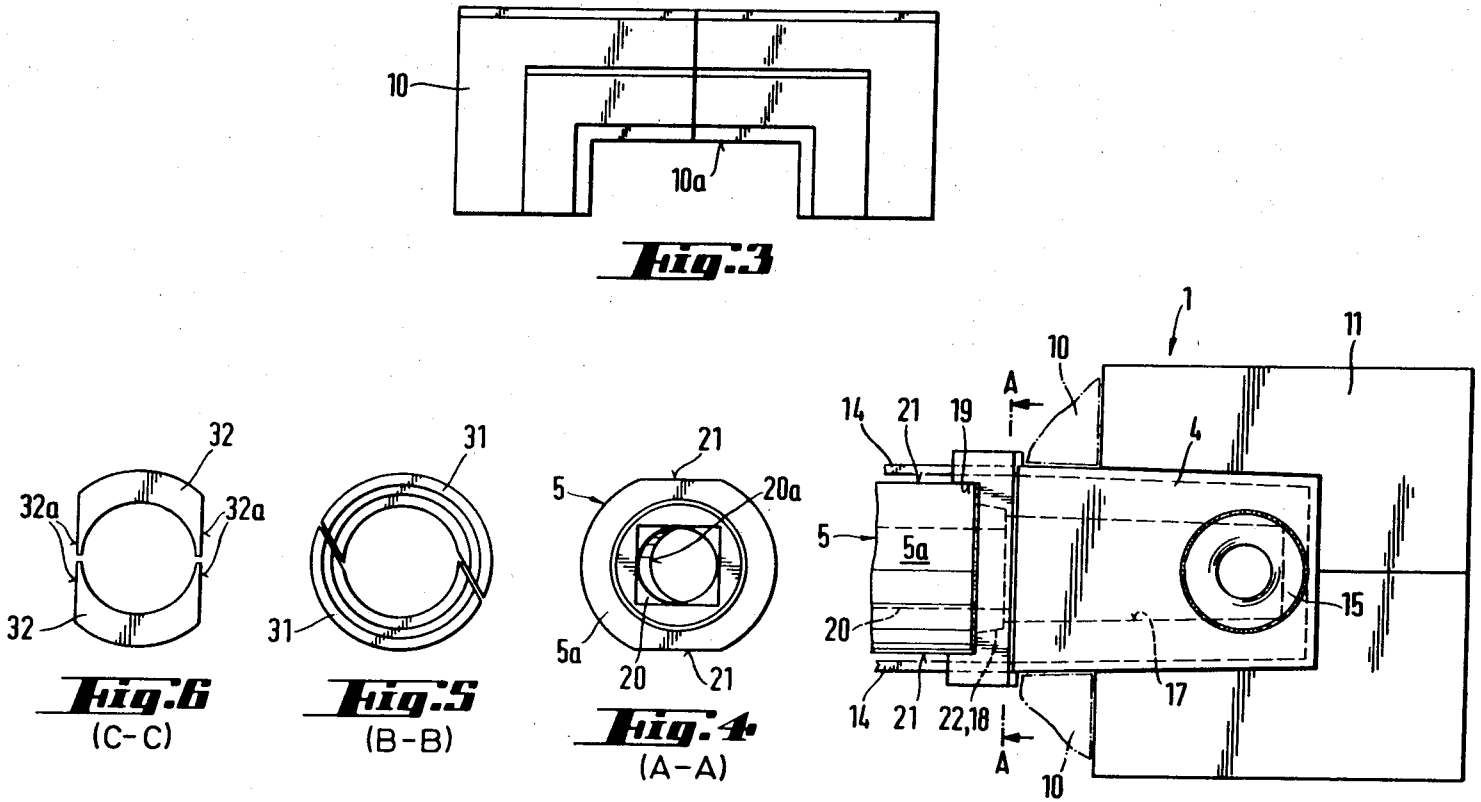
FIG. 2 is a top plan view of a spout member of the assembly shown in FIG. 1.
FIG. 3 is a front elevation view of a shaped brick employed for mounting the spout member.
Figure 7:
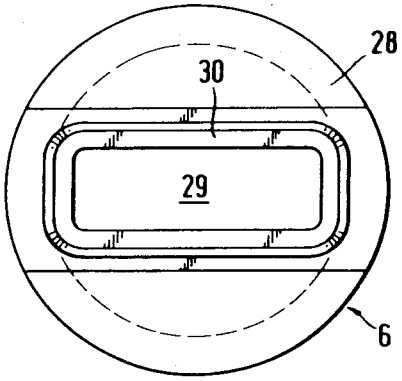
FIG. 7 is an enlarged end view of the casting tube shown in FIG. 1, taken from the left side thereof.
Figure 8:
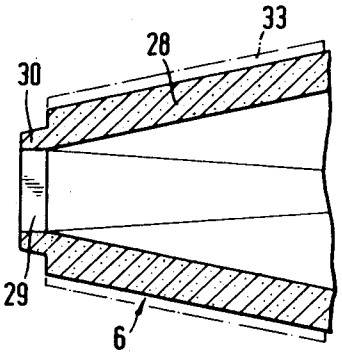
FIG. 8 is a sectional view of the discharge end of the casting tube.

Spout member 4 is removeably and replaceably mounted in a reinforced area of a metal jacket 8 surrounding a refractory lining 9 of vessel 1. The spout member 4 is accessible to the exterior from one side, as particularly shown in FIG. 1. The spout member 4 is positioned in the lining 9 at a predetermined location therein by means of particularly shaped bricks 10, 11. Thus, brick 10 is generally portal-shaped and has therein an upwardly extending recess 10*a* as shown in FIG. 3 and defining an upper surface and opposite side surfaces. Brick 10 is mounted in a wall of the refractory lining 9 such that the aligning surfaces thereof abut with corresponding surfaces of the spout member 4. Brick 11 is a generally horseshoe-shaped brick as shown particularly in FIG. 2 and has an inwardly and horizontally extending recess defining an inner surface and opposite side surfaces which abut with an inner end face and opposite side faces of the spout member 4. On the sides toward the interior of the vessel, the bricks 10 and 11 are flush with the inner walls of the vessel, on which is deposited a mortar or embedding material 12. To ensure easy exchange or replacement of the spout member 4, the cross section of the spout member on the sides and on the bearing area is tapered to converge toward the inner end face. Furthermore, a mounting bar or plate 14 may be embedded in a groove around the side faces and inner end face of the spout member 4. Bar 14 may project at both ends thereof from the outer end face of the spout member, as shown particularly in FIG. 2.

At the top of the spout member, that is on the side thereof directed toward the bottom of the vessel, there is provided an outlet member 15 embedded in the spout member and having a discharge opening joining a discharge channel 17 extending through spout member 4. Outlet member 15 cooperates with a stopper 16 of the vessel to interrupt the discharge of molten steel from the interior of the vessel into discharge channel 17. Channel 17 has a rectangular cross section that flares outwardly slightly in the direction of discharge.

Channel 17 exits on the outer end face of spout member 4 wherein there is formed a circular groove 18. The outer end of the spout member has an outwardly extending flange defining vertical guides 19.

Preferably, spout member 4 is a refractory prefabricated element formed of a hydraulically or chemically bound refractory concrete with an admixture of steel fibers in the wall area of discharge channel 17. Such a component has an accurate construction which makes it possible to accurately reproduce the location of the discharge channel after each exchange of members 4. The outlet member 15 and support bar 14 are embedded in the spout member 4 as exchangeable elements.

In accordance with the present invention, the coupling element 5 includes two separate elements, i.e. a generally cylindrical body 5*a* having at an inlet end thereof an outwardly extending flange 22 mating in groove 18, and a generally hemispherically shaped member 5*b* connected to cylindrical body 5*a* by means of a mating annular flange 23 and an annular groove 24. Elements 5*a*, 5*b* have therethrough respective channels 20, 20*a*. The cross section of channel 20*a* is circular, as is the cross section of a flow passage through casting tube 6. Channel 20 through body 5*a* varies and transduces from the rectangular cross section of discharge channel 17 to the circular cross section of channel 20*a*. Body 5*a* has on the exterior thereof planar surfaces 21 which mate with and are guided by planar guides 19. The element 5 is formed in the two separate members 5*a*, 5*b* for reasons of production engineering which are assembled into one component by means of flange 23 and groove 24.

The casting tube 6 has an inlet end including an outwardly extending flange 6*a* having a concave surface 6*b* seating on the hemispherically shaped member 5*b*. Flange 6*a* also has a planar surface 6*c*. A metal jacket 27 is fitted around the inlet end including the flange 6*a* of the casting tube by a mortar layer 26. Jacket 27 has a planar surface abutting the planar surface 6*c* of the flange 6*a*.

The major length, tubular portion of casting tube 6 is enclosed by insulation which is in the form of half shell-shaped members 31, 32, the shapes of which particularly are shown in FIGS. 5 and 6, respectively. These insulation members are of molded ceramic fibrous material, and the half shell-shaped members have substantially semi-annular cross sectional configurations. Members 32 are provided with parallel mating surfaces 32*a* for insertion into a holding frame 34 which is a component part of an adjustable slide device, not shown in detail herein, but which is used to position the casting tube 6.

The outlet end 28 of the casting tube 6 is flared inwardly in a flattened manner such that the outlet end of the flow passage through the casting tube has a generally rectangular profile 29, of the same general cross sectional shape as the profile of ingot mold 2.

Holding frame 34 is provided with a substantially U-shaped cross section and has a bearing surface 35 which supports metal jacket 27 against planar surface 6*c* of casting tube 6. The casting tube 6 thus is supported by metal jacket 27 on free end face 36 of holding frame 34, as shown particularly in FIG. 1. Casting tube 6 is clamped into position in the holding frame 34 by devices which, for the sake of simplicity, are not illustrated.

The outlet end of the casting tube has extending therefrom a peripheral flange or tongue 30 which fits within a correspondingly shaped groove 37 in the inlet end of nozzle 7. In accordance with the present invention the nozzle includes a main body and a separate nozzle tip *7a* which extends into ingot mold 2 and coacts sealingly with the walls thereof, for example formed by moving belts moving in the direction of steel withdrawal. The nozzle 7 thus generally has an exterior configuration of the same cross section as the ingot mold. In the illustrated embodiment, this shape is of a generally prismatic body having therethrough a flow channel 38 flaring outwardly on all sides toward the nozzle tip *7a*. At the outlet end of the nozzle tip the refractory material thereof makes sealing contact with the ingot mold walls via a peripheral outwardly extending flange or rim 39. The remaining exterior cross section of the nozzle tip *7a* and the main body of the nozzle is recessed to define a reduced dimension area to receive a peripheral insulation layer 40 formed of ceramic fibrous material and a metal housing 41 the exterior of which is flush with the peripheral rim 39. Metal housing 41 is made of a heat-resistant special alloy which will provide a strength of, e.g., approximately 10 kg/mm$^2$ at 900° C.

Figure 9:
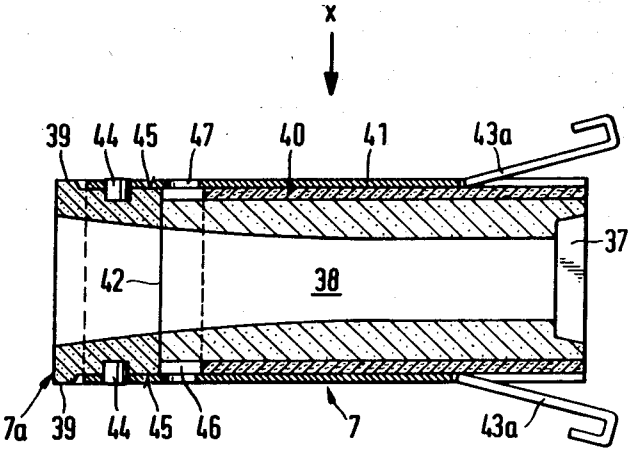
FIG. 9 is an enlarged cross sectional view of the nozzle shown in FIG. 1.
Figure 12:
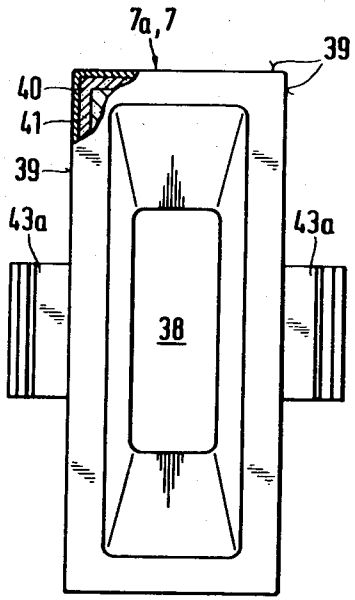
FIG. 12 is an end view taken from the direction of arrow Z in FIG. 10.
Figure 10:
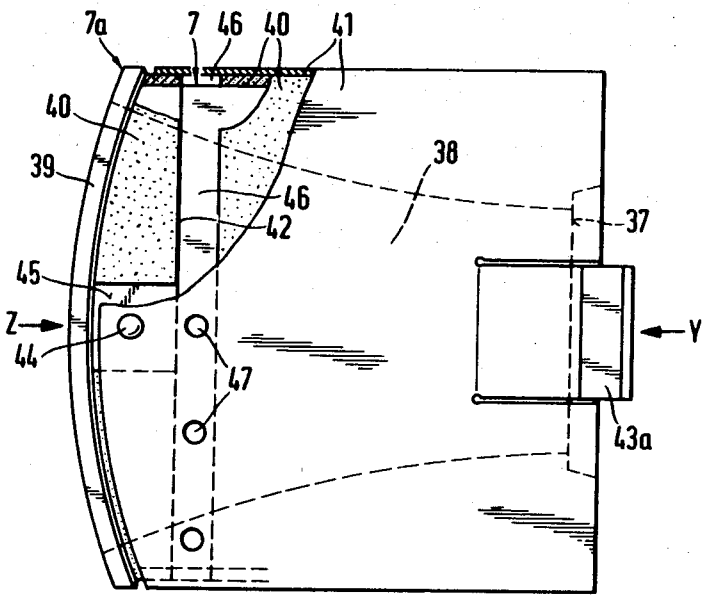
FIG. 10 is a top plan view, partially broken away, and taken from the direction of arrow X in FIG. 9.
Figure 11:
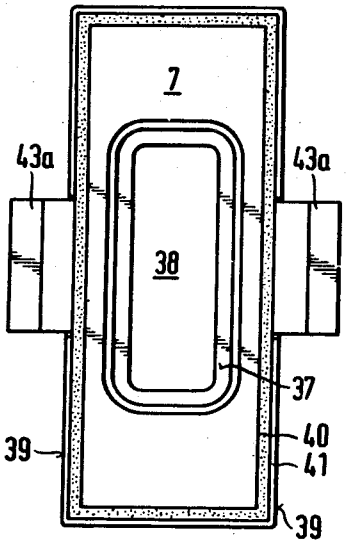
FIG. 11 is an end view taken in the direction of arrow Y of FIG. 10.

Nozzle tip *7a* is a separate element and is coupled with the main body of nozzle 7 via mutual abutting planar ground smooth surfaces 42, with the aid of a centering pin, not shown herein. Contact force between surfaces 42 is achieved by chucking devices 43 which are hinged to holding frame 34, which urge nozzle 7 against casting tube 6, and which urge nozzle *7a* against the main body of the nozzle. Specifically, metal housing 41 includes outwardly bent hooks 43*a* which are connected to chucking devices 43. The outer end of metal housing 41 has fixed thereto pins 44 which extend into appropriate recesses in tip *7a*. It thus will be apparent, particularly from a consideration of FIGS. 1 and 9, that chucking devices 43 operate to urge nozzle 7 toward casting tube 6 and to urge tip *7a* against the main body of the nozzle.

In accordance with a further feature of the present invention, a peripheral space 46 is provided around the main body of nozzle 7 at the area of the abutting respective planar surfaces 42. This space 46 may be provided by eliminating an outlet end portion of the insulation layer 40. Inert gas may be introduced into space 46, for example by means of lines installed within metal housing 41 in a manner not shown herein in detail, but which would be understood by one skilled in the art. In the area of space 46, metal housing 41 is provided with holes 47 so that the inert gas escapes through such holes and through a gap between the ingot mold walls and the nozzle 7, thereby forming a curtain of inert gas to maintain atmospheric air away from the ingot mold.

The spout member 4 is formed of a refractory concrete. The coupling element 5 and casting tube 6 preferably are formed from a graphite-containing alumina material. Those skilled in the art readily would understand the specific compositions of such materials which may be employed in the present invention. Nozzle 7 basically functions as an extruder die. The main body of nozzle 7 as well as tip *7a* are formed of molten metal-repellent material, preferably an alumina-graphite material, ceramically cast fused silica, or a high-percentage zirconium oxide material. Again, one of ordinary skill in the art readily would understand the specific compositions of materials which could be employed for the nozzle elements.

The mounting of a refractory conduit assembly according to the present invention, for example for the horizontal casting of a strand of billets with a cross section of 70 mm by 180 mm at a casting rate of one metric ton per minute and at a teeming rate of 10 meters per minute, will be achieved in the following manner.

Firstly, coupling element 5 is assembled by cementing hemispherically shaped member 5*b* and cylindrical body 5*a* to spout member 4 and by similarly cementing outlet member 15 to spout member 4. The thus preassembled unit of elements 4, 15, 5*a*, 5*b* is brought to the predetermined position within the lining of the vessel, as set by shaped bricks 10, 11, facilitated by means of mounting bar 14 or other suitable mounting devices. Due to the accurate and uniform construction of the spout member 4 from a refractory concrete, relatively little joint mortar will be required to fix the spout member in position in the lining of the vessel. Casting tube 6 including metal jacket 27 then is secured in a predetermined position in holding frame 34, along with insulation members 31, 32, 33. The nozzle tip *7a* is assembled to the main body of nozzle 7, and this unit is attached to casting tube 6 by means of chucking devices 43 which join nozzle tip *7a* to the main body of the nozzle and which urge the nozzle to the casting tube. Particular or special washers or shields may be provided between these elements. Then, parts 6, 7, *7a* are mounted on the sliding holding frame 34 and are positioned to abut against element 5, i.e. with concave surface 6*b* against hemispherical shaped member 5*b*. This seal again may be aided by a special washer or seal. Contact force is achieved by means of the operation of the adjustable sliding holding frame. Finally, the casting machine or ingot mold, which also is adjustable, is brought to the operating position shown in FIG. 1.

Although the present invention has been described and illustrated with respect to preferred features thereof, it is to be understood that various changes and modifications, as will be apparent to those skilled in the art, may be made without departing from the scope of the present invention. Particularly, those skilled in the art readily will understand the specific materials and compositions thereof which may be employed for the various refractory elements and insulation elements of the present invention.

We claim:

1. A refractory conduit assembly, particularly for the transfer of molten steel from a discharge vessel to an ingot mold of a horizontal continuous casting plant having revolving ingot mold walls in the form of endless belts, said assembly comprising:

a replaceable spout member adapted to be removably connected at a predetermined location to a vessel, said spout member having therethrough a discharge channel of rectangular cross section to receive from the interior of the vessel a flow of molten steel and to lead such flow to the exterior of the vessel, said spout member comprising a prefabricated wedge-shaped element adapted to be built into a lining of the vessel and to be accessible from the outer surface thereof, and means for locating said spout member in said predetermined location in the vessel lining;

shut off means for interrupting the flow to said discharge channel, said shut off means including an outlet member embedded in said spout member and having therethrough a discharge opening joining said discharge channel and adapted to be blocked by a stopper;

a casting tube located at a position outside of the vessel, said casting tube having therethrough a flow passage with inlet and outlet ends;

a coupling means for connecting said inlet said end of said flow passage to said discharge channel, such that the flow of molten steel passes through said casting tube, said coupling means located at a position outside of the vessel;

said outlet end of said flow passage having a cross-sectional configuration different from that of said inlet end thereof and adapted to that of an ingot mold to which the flow of molten steel is to be supplied; and a nozzle having an inlet end connected to said casting tube and an outlet end having thereat means for sealingly contacting walls of the ingot mold, said nozzle having therethrough a flow channel to pass the flow of molten steel from said casting tube to the ingot mold.

2. An assembly as claimed in claim 1, wherein said locating means comprises shaped bricks adapted to be built into the vessel lining and having surfaces to be abutted by mating surfaces of said spout member.

3. An assembly as claimed in claim 2, wherein said bricks comprise a first brick adapted to be built into a wall of the vessel lining and having therein a vertically upwardly extending recess defining an upper surface and side surfaces abutting mating surfaces of said spout member, and a second brick adapted to be built into the bottom of the vessel lining and having therein a horizontally inwardly extending recess defining an inner surface abutting an inner end face of said spout member and side surfaces abutting side walls of said spout member.

4. An assembly as claimed in claim 1, wherein said spout member is formed of chemically or hydraulically bound refractory concrete.

5. An assembly as claimed in claim 4, wherein said spout member has embedded therein a mounting plate extending outwardly from the vessel.

6. An assembly as claimed in claim 4, wherein said refractory concrete has embedded therein, in the area defining said discharge channel, steel fibers.

7. An assembly as claimed in claim 1, wherein said casting tube includes a main tube portion having around the exterior thereof insulation in the form of half shell-shaped members, and a flared outlet portion having around the exterior thereof framed mat insulation made of ceramic fibrous material.

8. An assembly as claimed in claim 7, wherein said outlet portion includes an end having a flange surrounding said outlet end of said flow passage, said flange fitting in a groove formed in said inlet end of said nozzle.

9. An assembly as claimed in claim 1, wherein said nozzle is formed of a molten steel-repellent ceramic material, said sealing means comprises an outer peripheral rim of said outlet end of said nozzle, and said nozzle has fitted therearound an insulation layer over said nozzle and a metal housing over said insulation layer, the outer surface of said metal housing being flush with said rim.

10. A refractory conduit assembly, particularly for the transfer of molten steel from a discharge vessel to an ingot mold of a horizontal continuous casting plant having revolving ingot mold walls in the form of endless belts, said assembly comprising:

a replaceable spout member adapted to be removably connected at a predetermined location to a vessel, said spout member having therethrough a discharge channel to receive from the interior of the vessel a flow of molten steel and to lead such flow to the exterior of the vessel, said spout member comprising a prefabricated wedge-shaped element adapted to be built into a lining of the vessel and to be accessible from the outer surface thereof;

means for locating said spout member in said predetermined location in the vessel lining;

shut off means for interrupting the flow to said discharge channel;

a casting tube located at a position outside of the vessel, said casting tube having therethrough a flow passage with inlet and outlet ends;

a coupling means for connecting said inlet said end of said flow passage to said discharge channel, such that the flow of molten steel passes through said casting tube, said coupling means located at a position outside of the vessel;

said spout member including an outer end having means for connecting said spout-member to said coupling means;

said outlet end of said flow passage having a cross-sectional configuration different from that of said inlet end thereof and adapted to that of an ingot mold to which the flow of molten steel is to be supplied; and a nozzle having an inlet end connected to said casting tube and an outlet end having thereat means for sealingly contacting walls of the ingot mold, said nozzle having therethrough a flow channel to pass the flow of molten steel from said casting tube to the ingot mold.

11. An assembly as claimed in claim 10, wherein said connecting means comprises planar guide surface abutting planar side surfaces of said coupling means.

12. An assembly as claimed in claim 11, wherein said connecting means futher comprises a circular groove surrounding said discharge channel and receiving a circular flange on said coupling means.

13. An assembly as claimed in claim 10, wherein said locating means comprises shaped bricks adapted to be built into the vessel lining and having surfaces to be abutted by mating surfaces of said spout member.

14. An assembly as claimed in claim 13, wherein said bricks comprise a first brick adapted to be built into a wall of the vessel lining and having therein a vertically upwardly extending recess defining an upper surface and side surfaces abutting mating surfaces of said spout member, and a second brick adapted to be built into the bottom of the vessel lining and having therein a horizontally inwardly extending recess defining an inner surface abutting an inner end face of said spout member and side surfaces abutting side walls of said spout member.

15. An assembly as claimed in claim 10, wherein said spout member is formed of chemically or hydraulically bound refractory concrete.

16. An assembly as claimed in claim 15, wherein said spout member has embedded therein a mounting plate extending outwardly from the vessel.

17. An assembly as claimed in claim 15, wherein said refractory concrete has embedded therein, in the area defining said discharge channel, steel fibers.

18. An assembly as claimed in claim 10, wherein said casting tube includes a main tube portion having around the exterior thereof insulation in the form of half shell-shaped members, and a flared outlet portion having around the exterior thereof framed mat insulation made of ceramic fibrous material.

19. An assembly as claimed in claim 18, wherein said outlet portion includes an end having a flange surrounding said outlet end of said flow passage, said flange fitting in a groove formed in said inlet end of said nozzle.

20. An assembly as claimed in claim 10, wherein said nozzle is formed of a molten steel-repellent ceramic material, said sealing means comprises an outer peripheral rim of said outlet end of said nozzle, and said nozzle has fitted therearound an insulation layer over said nozzle and a metal housing over said insulation layer, the outer surface of said metal housing being flush with said rim.

21. A refractory conduit assembly, particularly for the transfer of molten steel from a discharge vessel to an ingot mold of a horizontal continuous casting plant having revolving ingot mold walls in the form of endless belts, said assembly comprising:

a replaceable spout member adapted to be removably connected at a predetermined location to a vessel, said spout member having therethrough a discharge channel to receive from the interior of the vessel a flow of molten steel and to lead such flow to the exterior of the vessel, said spout member comprising a prefabricated wedge-shaped element adapted to be built into a lining of the vessel and to be accessible from the outer surface thereof;

means for locating said spout member in said predetermined location in the vessel lining;

shut off means for interrupting the flow to said discharge channel;

a casting tube located at a position outside of the vessel, said casting tube having therethrough a flow passage with inlet and outlet ends;

a coupling means for connecting said inlet said end of said flow passage to said discharge channel, such that the flow of molten steel passes through said casting tube, said coupling means located at a position outside of the vessel, said coupling means including a generally cylindrical body connected to said spout member and a generally hemispherically shaped member connected to said cylindrical body and to said casting tube, said cylindrical body and said hemispherically shaped member having therethrough connected respective channels connecting said discharge channel to said flow passage;

said outlet end of said flow passage having a cross-sectional configuration different from that of said inlet end thereof and adapted to that of an ingot mold to which the flow of molten steel is to be supplied; and a nozzle having an inlet end connected to said casting tube and an outlet end having thereat means for sealingly contacting walls of the ingot mold, said nozzle having therethrough a flow channel to pass the flow of molten steel from said casting tube to the ingot mold.

22. An assembly as claimed in claim 21, wherein said discharge channel has a rectangular cross section, said flow passage and said channel of said hemispherically shaped member have circular cross sections, and said channel of said cylindrical body has a cross section changing from rectangular to circular.

23. An assembly as claimed in claim 21, wherein said channel of said hemispherically shaped member is inclined to said channel of said cylindrical body and parallel to said flow passage.

24. An assembly as claimed in claim 21, wherein said cylindrical body is connected to said hemispherically shaped member by an annular flange engaged in a mating annular groove.

25. An assembly as claimed in claim 21, wherein said casting tube includes at an inlet end thereof a flange having a concave surface seating on said hemispherically shaped member, and a planar surface, and further comprising a metal jacket fixed about said inlet end including said flange by mortar, said jacket having a planar surface abutting said planar surface of said flange, and an adjustable metal holding frame abutting said jacket.

26. An assembly as claimed in claim 21, wherein said casting tube includes a main tube portion having around the exterior thereof insulation in the form of half shell-shaped members, and a flared outlet portion having around the exterior thereof framed mat insulation made of ceramic fibrous material.

27. An assembly as claimed in claim 26, wherein said outlet portion includes an end having a flange surrounding said outlet end of said flow passage, said flange fitting in a groove formed in said inlet end of said nozzle.

28. An assembly as claimed in claim 21, wherein said nozzle is formed of a molten steel-repellent ceramic material, said sealing means comprises an outer peripheral rim of said outlet end of said nozzle, and said nozzle has fitted therearound an insulation layer over said nozzle and a metal housing over said insulation layer, the outer surface of said metal housing being flush with said rim.

29. An assembly as claimed in claim 21, wherein said locating means comprises shaped bricks adapted to be built into the vessel lining and having surfaces to be abutted by mating surfaces of said spout member.

30. An assembly as claimed in claim 29, wherein said bricks comprise a first brick adapted to be built into a wall of the vessel lining and having therein a vertically upwardly extending recess defining an upper surface and side surfaces abutting mating surfaces of said spout member, and a second brick adapted to be built into the bottom of the vessel lining and having therein a horizontally inwardly extending recess defining an inner surface abutting an inner end face of said spout member and side surfaces abutting side walls of said spout member.

31. An assembly as claimed in claim 21, wherein said spout member is formed of chemically or hydraulically bound refractory concrete.

32. An assembly as claimed in claim 31, wherein said spout member has embedded therein a mounting plate extending outwardly from the vessel.

33. An assembly as claimed in claim 31, wherein said refractory concrete has embedded therein, in the area defining said discharge channel, steel fibers.

34. A refractory conduit assembly, particularly for the transfer of molten steel from a discharge vessel to an ingot mold of a horizontal continuous casting plant having revolving ingot mold walls in the form of endless belts, said assembly comprising:

a replaceable spout member adapted to be removably connected at a predetermined location to a vessel, said spout member having therethrough a discharge channel to receive from the interior of the vessel a flow of molten steel and to lead such flow to the exterior of the vessel;

shut off means for interrupting the flow to said discharge channel;

a casting tube located at a position outside of the vessel, said casting tube having therethrough a flow passage with inlet and outlet ends;

a coupling means for connecting said inlet said end of said flow passage to said discharge channel, such that the flow of molten steel passes through said casting tube, said coupling means located at a position outside of the vessel;

said outlet end of said flow passage having a cross-sectional configuration different from that of said inlet end thereof and adapted to that of an ingot mold to which the flow of molten steel is to be supplied;

a nozzle having an inlet end connected to said casting tube and an outlet end having thereat means for sealingly contacting walls of the ingot mold, said nozzle having therethrough a flow channel to pass the flow of molten steel from said casting tube to the ingot mold, said nozzle being formed of a molten steel-repellent ceramic material, said sealing means comprising an outer peripheral rim of said outlet end of said nozzle, and said nozzle having fitted therearound an insulation layer over said nozzle and a metal housing over said insulation layer, the outer surface of said metal housing being flush with said rim;

a holding frame supporting said casting tube; and chuck means mounted on said holding frame and connected to said metal housing for holding said nozzle against said casting tube.

35. An assembly as claimed in claim 34, wherein said nozzle includes a main body having therearound said insulation layer and a separate nozzle tip including said peripheral rim, said main body and said nozzle tip abutting each other at respective planar surfaces.

36. An assembly as claimed in claim 35, further comprising pins supported by said metal housing and embedded in said nozzle tip, whereby said chuck means, said metal housing and said pins move said nozzle tip toward said main body.

37. An assembly as claimed in claim 35, further comprising a peripheral space around said main body between said abutting respective planar surfaces and said layer of insulation, whereby inert gas may be supplied to said peripheral space, and wherein said metal housing has therethrough holes communicating with said peripheral space.

38. An assembly as claimed in claim 34, wherein said spout member comprises a prefabricated wedge-shaped element adapted to be built into a lining of the vessel and to accessible from the outer surface thereof, and further comprising means for locating said spout member in said predetermined location in the vessel lining.

39. An assembly as claimed in claim 38, wherein said locating means comprises shaped bricks adapted to be built into the vessel lining and having surfaces to be abutted by mating surfaces of said spout member.

40. An assembly as claimed in claim 39, wherein said bricks comprise a first brick adapted to be built into a wall of the vessel lining and having therein a vertically upwardly extending recess defining an upper surface and side surfaces abutting mating surfaces of said spout member, and a second brick adapted to be built into the bottom of the vessel lining and having therein a horizontally inwardly extending recess defining an inner surface abutting an inner end face of said spout member and side surfaces abutting side walls of said spout member.

41. An assembly as claimed in claim 38, wherein said discharge channel has a rectangular cross section, and wherein said shut off means includes an outlet member embedded in said spout member and having therethrough a discharge opening joining said discharge channel and adapted to be blocked by a stopper.

42. An assembly as claimed in claim 38, wherein said spout member is formed of chemically or hydraulically bound refractory concrete.

43. An assembly as claimed in claim 42, wherein said spout member has embedded therein a mounting plate extending outwardly from the vessel.

44. An assembly as claimed in claim 42, wherein said refractory concrete has embedded therein, in the area defining said discharge channel, steel fibers.

45. An assembly as claimed in claim 34, wherein said casting tube includes a main tube portion having around the exterior thereof insulation in the form of half shell-shaped members, and a flared outlet portion having around the exterior thereof framed mat insulation made of ceramic fibrous material.

46. An assembly as claimed in claim 45, wherein said outlet portion includes an end having a flange surrounding said outlet end of said flow passage, said flange fitting in a groove formed in said inlet end of said nozzle.

* * * * *